US010174531B2

(12) United States Patent
Ro

(10) Patent No.: US 10,174,531 B2
(45) Date of Patent: Jan. 8, 2019

(54) LOCKING DEVICE

(71) Applicant: JOONG-ANG METAL CO., LTD., Yangju-si (KR)

(72) Inventor: Nam Yeal Ro, Uijeongbu-si (KR)

(73) Assignee: JOONG-ANG METAL CO., LTD., Yangju-si (KR)

( * ) Notice: Subject to any disclaimer, the term of this patent is extended or adjusted under 35 U.S.C. 154(b) by 497 days.

(21) Appl. No.: 14/775,850

(22) PCT Filed: Jul. 23, 2013

(86) PCT No.: PCT/KR2013/006582
§ 371 (c)(1),
(2) Date: Sep. 14, 2015

(87) PCT Pub. No.: WO2014/200145
PCT Pub. Date: Dec. 18, 2014

(65) Prior Publication Data

US 2016/0090761 A1 Mar. 31, 2016

(30) Foreign Application Priority Data

Jun. 13, 2013 (KR) ..... 10-2013-0067578

(51) Int. Cl.
*E05C 19/12* (2006.01)
*E05B 17/00* (2006.01)
(Continued)

(52) U.S. Cl.
CPC ..... *E05C 19/12* (2013.01); *E05B 17/0045* (2013.01); *E05C 3/12* (2013.01);
(Continued)

(58) Field of Classification Search
CPC ..... Y10T 292/0915; Y10T 292/0917; Y10T 292/0911; Y10T 292/0926;
(Continued)

(56) References Cited

U.S. PATENT DOCUMENTS 4,758,031 A * 7/1988 Wolf ..... E05C 19/105 292/111
5,012,794 A * 5/1991 Faurel ..... E05C 5/00 126/191
(Continued)

FOREIGN PATENT DOCUMENTS

EP 1840307 10/2007
EP 2508700 A1 * 10/2012 ..... E05C 19/105
(Continued)

OTHER PUBLICATIONS

International Search Report—PCT/KR2013/006582 dated Sep. 17, 2014.

*Primary Examiner* — Daniel J Troy
(74) *Attorney, Agent, or Firm* — Cantor Colburn LLP

(57) ABSTRACT

A locking device, in which a larger force is required only when a vertical moving block protruding from a lower surface of a locking hook is moved up and down while being in line contact with a vertical-movement support block, thus allowing the locking device to be easily used with a relatively smaller force. Further, the tilting guide is restored by a restoring force of a restoring member, so that no frictional force is generated between the tilting guide and the housing, thus preventing a noise from being generated and allowing for a smooth operation, thereby ensuring the ease of use.

10 Claims, 17 Drawing Sheets

(51) Int. Cl.

| | |
|---|---|
| ***E05C 19/10*** | (2006.01) |
| ***E05C 3/12*** | (2006.01) |
| ***E05C 3/14*** | (2006.01) |
| ***E05C 5/02*** | (2006.01) |
| ***E05C 19/00*** | (2006.01) |

(52) U.S. Cl.
CPC ..... *E05C 3/145* (2013.01); *E05C 5/02* (2013.01); *E05C 19/00* (2013.01); *E05C 19/105* (2013.01)

(58) Field of Classification Search
CPC ..... Y10T 292/0914; Y10T 292/0913; E05C 19/10; E05C 19/105; E05C 19/12; E05C 3/12
See application file for complete search history.

(56) References Cited

U.S. PATENT DOCUMENTS 5,400,987 A * 3/1995 Ziavras ..... B64G 1/222 244/172.6
5,669,638 A * 9/1997 Anderson ..... A47B 87/002 292/111

FOREIGN PATENT DOCUMENTS

| | | |
|---|---|---|
| JP | 11152950 | 6/1999 |
| JP | 2004050919 | 2/2004 |
| KR | 100407094 | 2/2004 |

* cited by examiner

LOCKING DEVICE

TECHNICAL FIELD

The present invention relates, in general, to locking devices and, more particularly, to a locking device of a casing and a cover, intended to safely store and convey expensive goods such as sound equipment.

BACKGROUND ART

Generally, expensive goods such as sound equipment are put into a casing and then are covered with a cover. Thereafter, the casing and the cover are locked by a locking device. In such a locked state, it is possible to safely store and convey the expensive goods.

The locking device of the casing and the cover was disclosed in Europe Patent No. 1,840,307, which pertains to a locking device for a transport box.

According to the previously registered patent, in the state where a shell is secured to each of the casing and the cover, as a handle rotates forwards, a tilting guide and a locking hook are moved forwards, and simultaneously, a cam moves up along a curved surface, so that they maintain an inclined state by a protruding height of the curved surface.

In this case, the tilting guide is pressed by a lead spring that is secured to a housing, so that the removal of the tilting guide is prevented.

Further, after the contact of side ends of respective shells, as the handle rotates backwards, the cam moves down along the curved surface, so that the tilting guide and the locking hook are moved downwards, and simultaneously, the locking hook is moved rearwards while being coupled to a space of the locking housing. Thereby, the locking hook is caught by the space to be locked thereto, thus maintaining a locked state of the casing and the cover.

In the previously registered patent, the lead spring pressing an end of the tilting guide downwards is secured to the housing with a rivet. However, this is problematic in that a working process of securing the lead spring to the housing with the rivet is complicated, and in addition, a frictional force between the tilting guide and the lead spring is excessively generated when the handle is rotated in the state where a front end of the lead spring comes into close contact with the tilting guide, so that the rotation of the handle and the forward and rearward movement of the locking hook are not smoothly performed, thus causing inconvenience.

Further, it is problematic in that the handle should be rotated 180 degrees or more to allow the cam to be moved up and down along the curved surface, so that a larger force is required, and thereby it is inconvenient to use and friction noise and abrasion may undesirably occur due to a point contact between the cam and the curved surface.

Furthermore, the curved surface is formed to protrude from the shell in a conical shape. However, it is problematic in that a working process for precisely forming the curved surface is difficult, causes defective forming, and increases manufacturing cost due to a waste of raw materials resulting from the defective forming.

DISCLOSURE

Technical Problem

Accordingly, the present invention has been made keeping in mind the above problems occurring in the prior art, and an object of the present invention is to provide a locking device, in which a tilting guide is rotatably coupled to a housing and is restored by a restoring force of a restoring member, so that no frictional force is generated between the tilting guide and the housing, thus enabling a rotation of a handle and a forward and rearward movement of a locking hook to be smoothly performed and thereby ensuring the ease of use.

Another object of the present invention is to provide a locking device, in which, when a locking hook is moved by a rotation of a handle, a larger force is required only when a vertical moving block protruding from a lower surface of a locking hook is moved up and down while being in line contact with a vertical-movement support block protruding from a shell, thus allowing the locking device to be easily used with a smaller force compared to the prior art wherein a handle is rotated to move a cam up and down along a curved surface.

A further object of the present invention is to provide a locking device, in which a vertical moving block protruding from a lower surface of a locking hook is in line contact with a vertical-movement support block protruding from a shell, so that a working process of forming the vertical-movement support block is simplified, and work efficiency is improved, as a result of which productivity is increased and manufacturing cost is reduced, so that the locking device of this invention is economical.

Technical Solution

In order to accomplish the above objects, the present invention provides a locking device, including:

a pair of shells having flanges that are in surface contact with a casing and a cover, any one of the shells being provided with a locking housing through which a catch hole is formed, a remaining one of the shells being provided with a vertical-movement support block to guide a vertical movement of a locking hook by rotation of a handle;

a housing secured to the shell having the vertical-movement support block to guide an operation of a tilting guide;

the tilting guide resiliently provided in the housing via a wire spring to guide a movement of the locking hook;

the locking hook caught by the catch hole of the locking housing to set a locking state or removed from the catch hole to release the set locking state, while the locking hook is moved along the tilting guide by a forward or backward rotation of the handle;

the handle rotatably provided on the tilting guide to move the locking hook forwards or rearwards;

a vertical moving block protruding from a lower surface of the locking hook, the vertical moving block being guided along the vertical-movement support block to be in line contact therewith, thus moving up the locking hook that is moved forwards when the handle rotates forwards; and a restoring part connected to the tilting guide and the housing to move down the locking hook and the tilting guide that are moved up while the vertical moving block is in line contact with the vertical-movement support block, thus restoring the locking hook and the tilting guide to original positions thereof.

Advantageous Effects

According to the present invention, the locking device is advantageous in that the tilting guide is rotatably coupled to the housing and is restored by the restoring force of the restoring member, so that no frictional force is generated between the tilting guide and the housing, thus enabling the rotation of the handle and the forward and rearward movement of the locking hook to be smoothly performed and thereby ensuring the ease of use.

Further, according to the present invention, the locking device is advantageous in that, when the locking hook is moved by the rotation of the handle, a larger force is required only when the vertical moving block protruding from the lower surface of the locking hook is moved up and down while being in line contact with the vertical-movement support block protruding from the shell, thus allowing the locking device to be easily used with a smaller force compared to the prior art wherein the handle is rotated to move the cam up and down along the curved surface.

Furthermore, according to the present invention, the locking device is advantageous in that the vertical moving block protruding from the lower surface of the locking hook is in line contact with the vertical-movement support block protruding from the shell, so that the working process of forming the vertical-movement support block is simplified, and work efficiency is improved, as a result of which productivity is increased and manufacturing cost is reduced, so that the locking device of this invention is economical.

DESCRIPTION OF THE REFERENCE NUMERALS IN THE DRAWINGS

Figure 1:
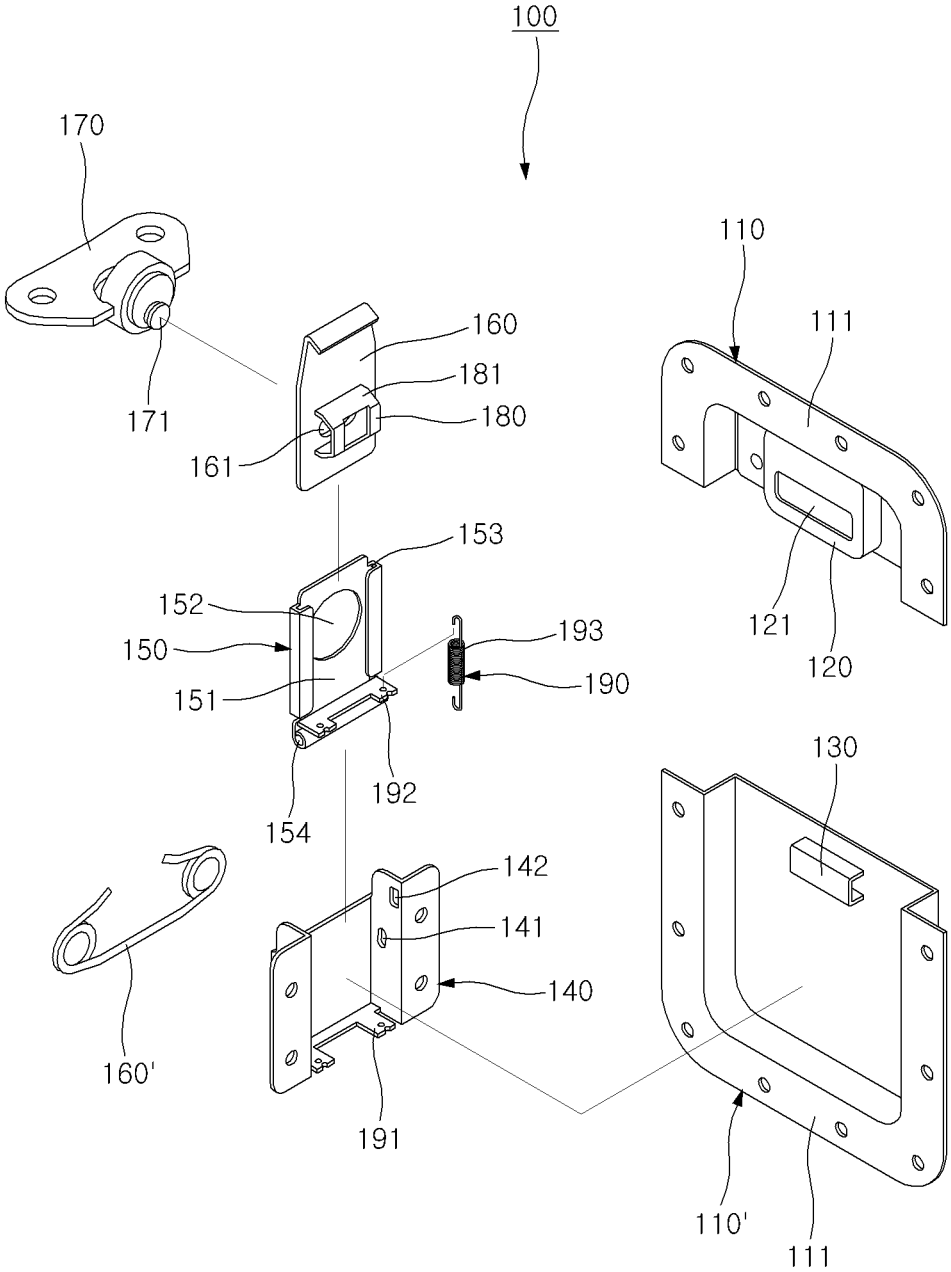
FIG. 1 is an exploded perspective view of the present invention.

100: locking device 110, 110': a pair of shells
120: locking housing 130: vertical-movement support block
140: housing 150: tilting guide
160: locking hook 170: handle
180: vertical moving block
190: restoring part

MODE FOR INVENTION

Figure 2:
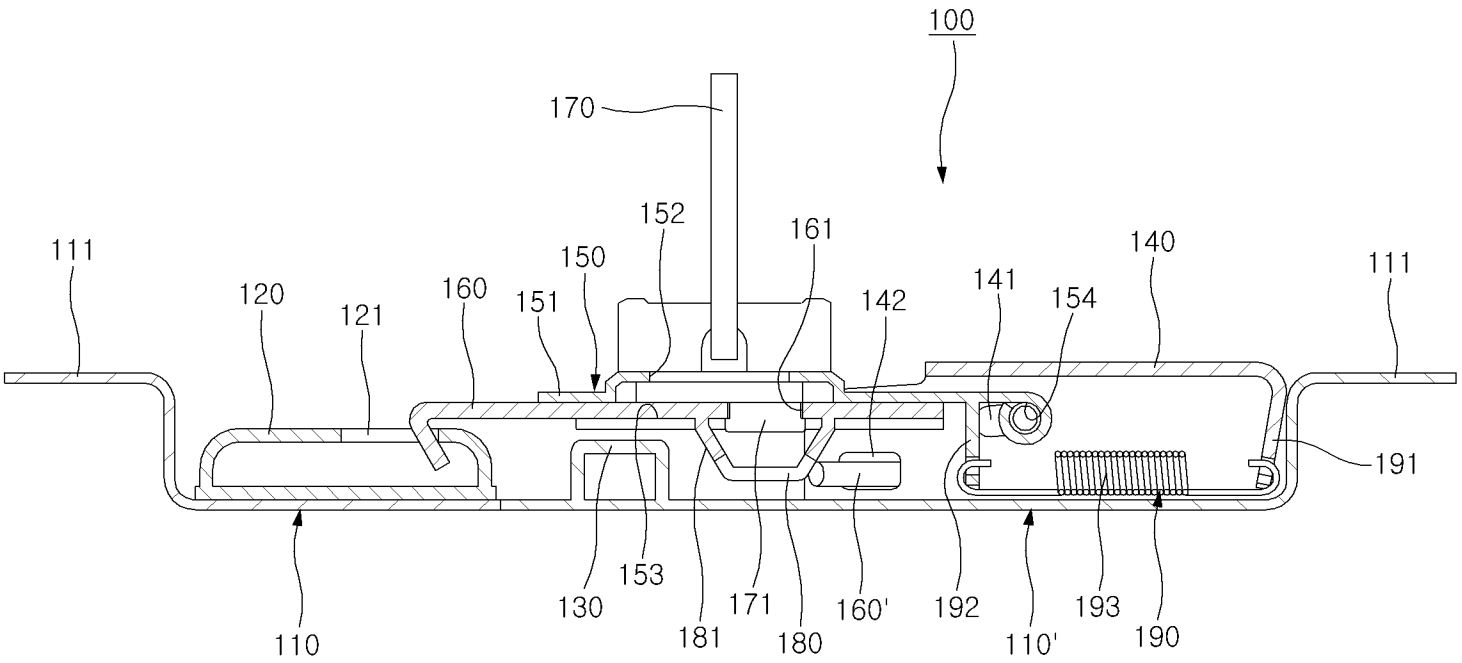
FIG. 2 is a front view showing a configuration of the present invention.

Hereinbelow, the present invention will be described in detail with reference to the accompanying drawings. FIG. 1 is an exploded perspective view of the present invention, and FIG. 2 is a front view showing a configuration of the present invention.

A locking device 100 of the present invention includes a pair of shells 110 and 110', a housing 140, a tilting guide 150, a locking hook 160, a handle 170, a vertical moving block 180, and a restoring part 190. The pair of shells 110 and 110' have flanges 111 that are in surface contact with a casing and a cover. Any one of the shells 110 and 110' is provided with a locking housing 120 through which a catch hole 121 is formed, while a remaining one is provided with a vertical-movement support block 130 to guide a vertical movement of the locking hook 160 by a rotation of the handle 170. The housing 140 is secured to the shell 110' having the vertical-movement support block 130 to guide the operation of a tilting guide 150. The tilting guide 150 is resiliently provided in the housing 140 via a wire spring 160' to guide the movement of the locking hook 160. The locking hook 160 is caught by the catch hole 121 of the locking housing 120 to set a locking state or is removed from the catch hole 121 to release the set locking state, while the locking hook 160 is moved along the tilting guide 150 by a forward or backward rotation of the handle 170. The handle 170 is rotatably provided on the tilting guide 150 to move the locking hook 160 forwards or rearwards. The vertical moving block 180 protrudes from a lower surface of the locking hook 160, and is guided along the vertical-movement support block 130 to be in line contact therewith, thus moving up the locking hook 160 that is moved forwards when the handle 170 rotates forwards. The restoring part 190 is connected to the tilting guide 150 and the housing 140 to move down the locking hook 160 and the tilting guide 150 that are moved up while the vertical moving block 180 is in line contact with the vertical-movement support block 130, thus restoring the locking hook 160 and the tilting guide 150 to original positions thereof. The above components will be described below in more detail.

A corner of the vertical-movement support block 130 is formed to protrude at right angles so that the vertical moving block 180 is in line contact with the vertical-movement support block 130 in a longitudinal direction to be moved up and down.

The tilting guide 150 includes a body 151 through which a rotary hole 152 is formed such that the handle 170 is rotatably mounted thereto, movement guide grooves 153 formed by bending both sides of the body 151 to guide a movement of the locking hook 160, and a coupling hole 154 formed by curving a rear end of the body 151 to allow the wire spring 160' to be coupled thereto.

The locking device further includes an elongated guide hole 161 formed through the locking hook 160 in a straight line to guide a rotary motion of an eccentric pin 171 for connecting the handle 170 to the locking hook 160.

A frictional surface 181 of the vertical moving block 180 is curved or inclined to make a side end of the vertical moving block 180 be in line contact with the vertical-movement support block 130.

Further, the restoring part 190 includes a fixed-side mounting piece 191 formed on a rear end of the housing 140, an operating-side mounting piece 192 formed on the tilting guide 150 to correspond to the fixed-side mounting piece 191, and a restoring member 193 secured to the fixed-side mounting piece 191 and the operating-side mounting piece 192.

The fixed-side/operating-side mounting pieces 191 and 192 and the restoring member 193 are preferably formed in pairs on both sides of the housing 140 and the tilting guide 150 in such a way as to be opposite to each other.

Further, the restoring part 190 includes an extension piece 194 extending a rear end of the tilting guide 150 into the housing 140, and a support member 195 mounted between the extension piece 194 and the shell 110' to resiliently support the extension piece 194.

Preferably, the support member 195 is a coil spring.

Further, preferably, the restoring part 190 is a plate spring 196, a rib 197 of the plate spring being rotatably coupled to the wire spring 160', a front end of the plate spring being in close contact with the lower surface of the tilting guide 150 and a rear end of the plate spring being in close contact with an inner corner of the housing 140.

Next, the assembly and operation of the present invention configured as such will be described.

Figure 3:
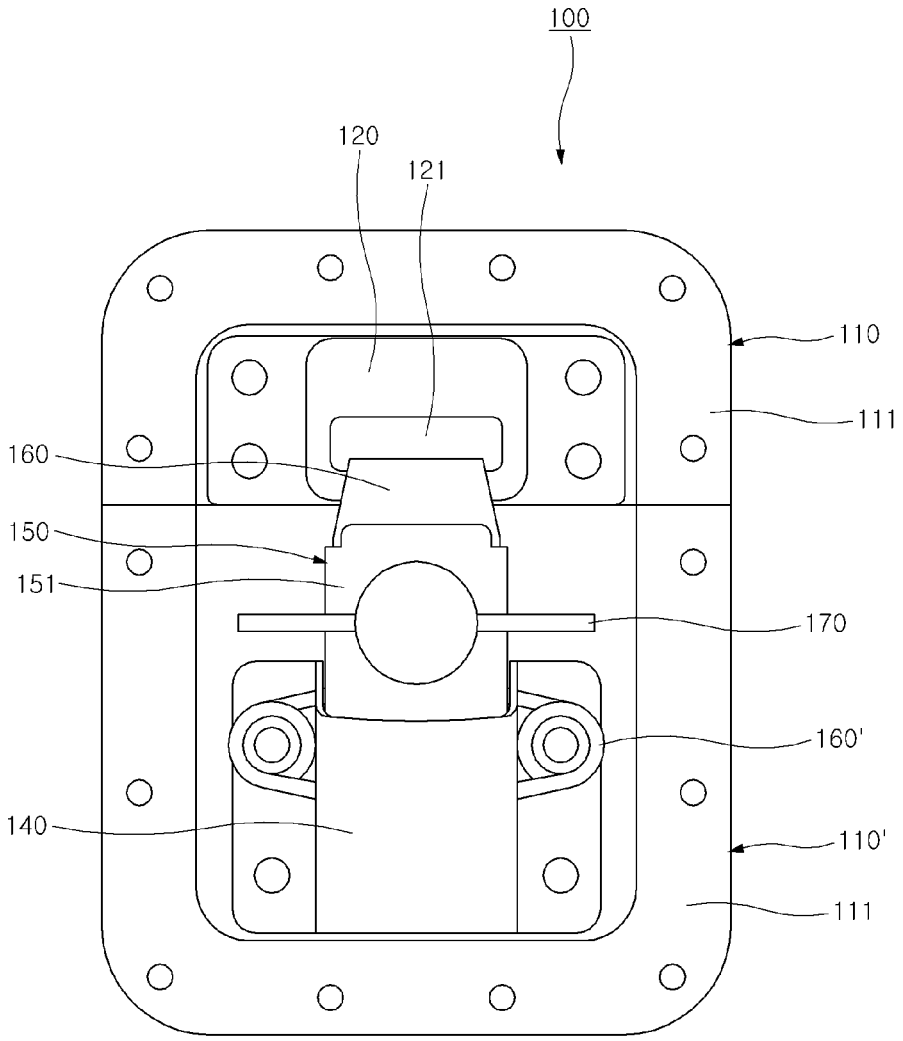
FIG. 3 is a sectional view of the present invention.
Figure 4:
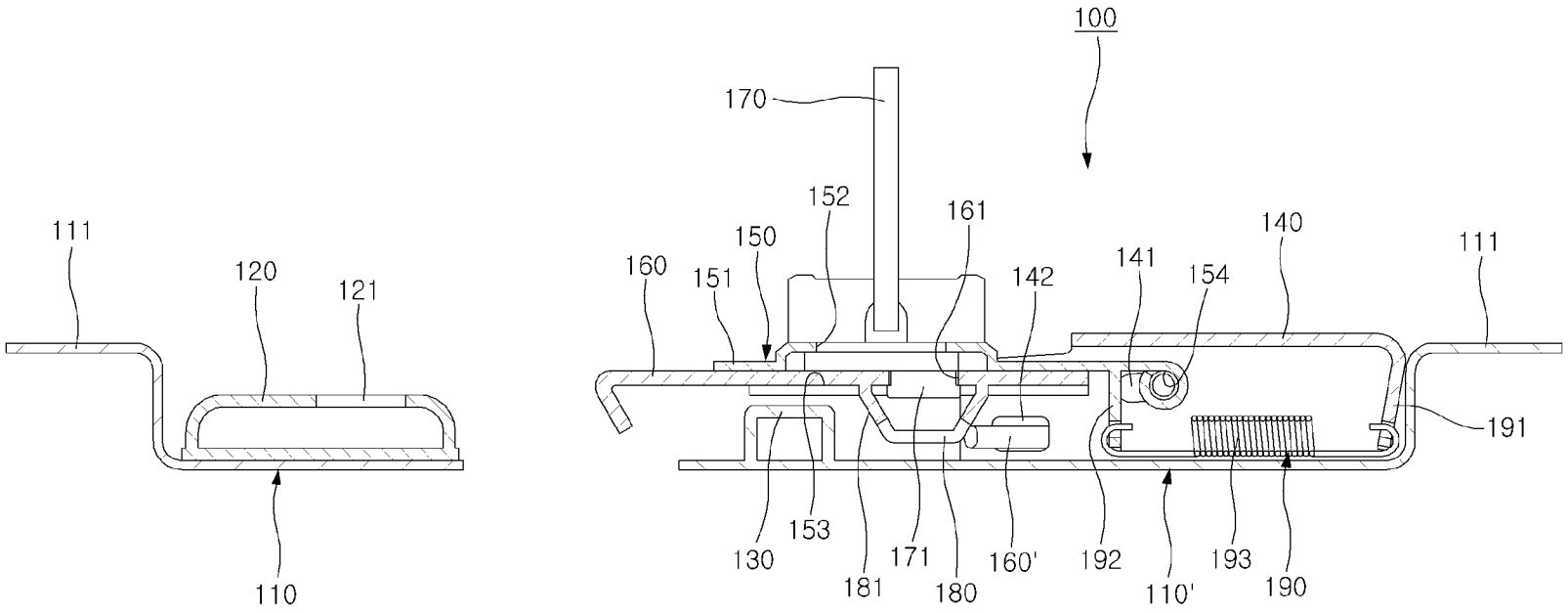
FIGS. 4 to 15 are views showing the use of the present invention.
Figure 5:
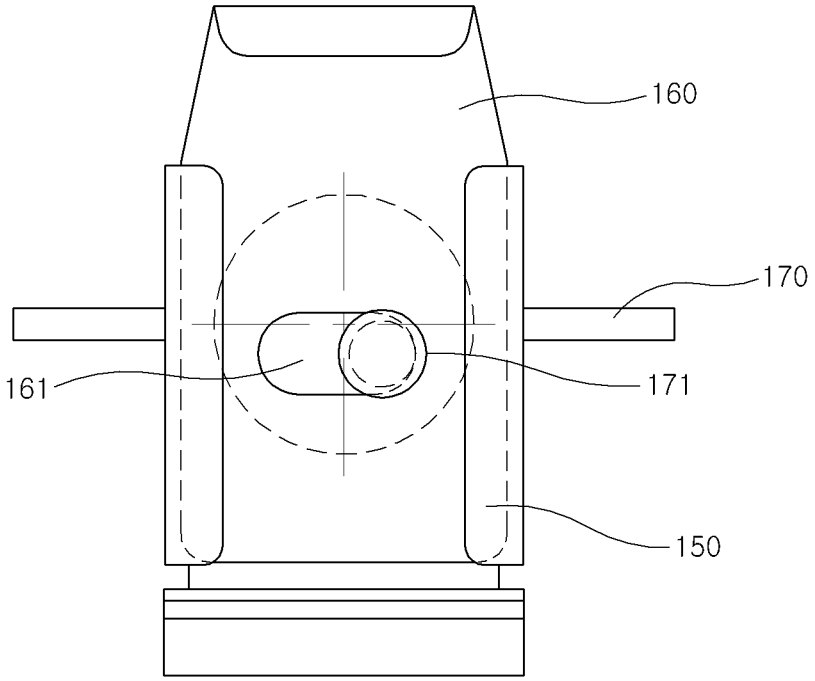
Figure 6:
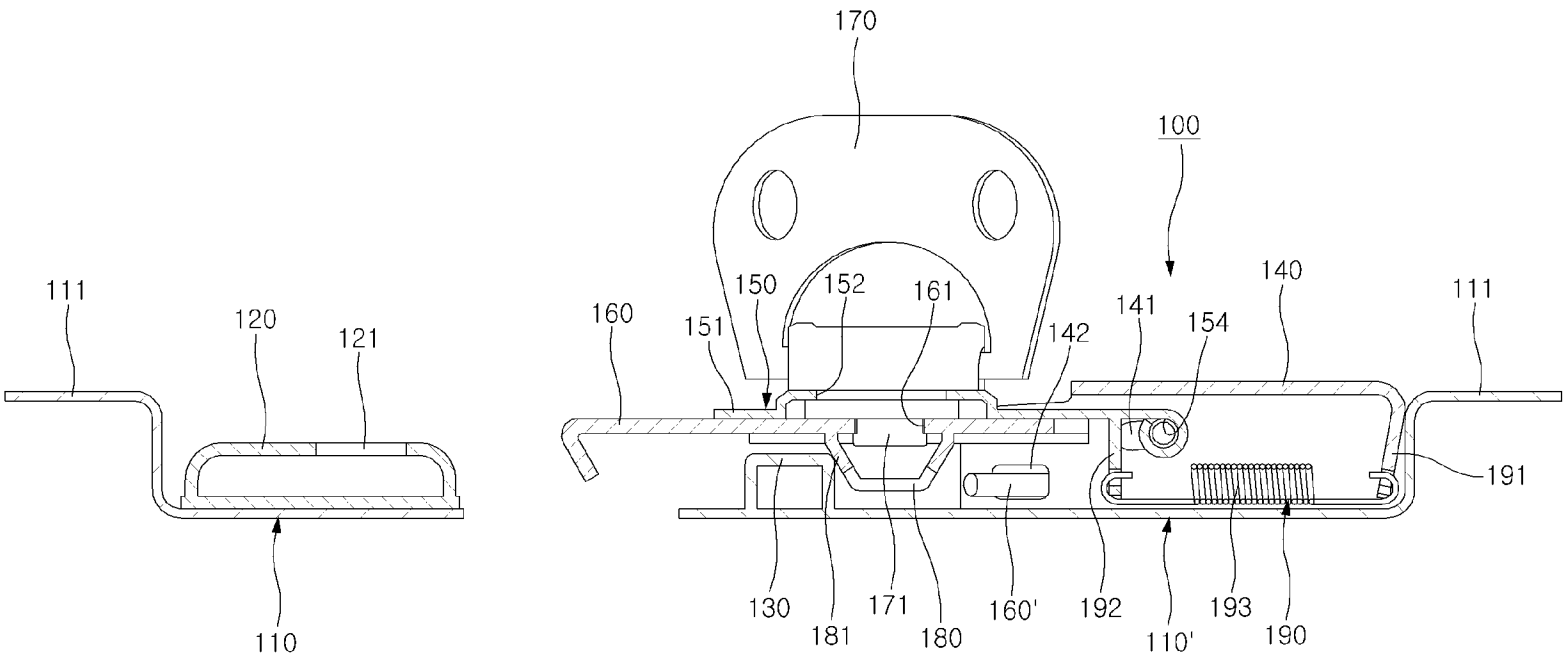
Figure 7:
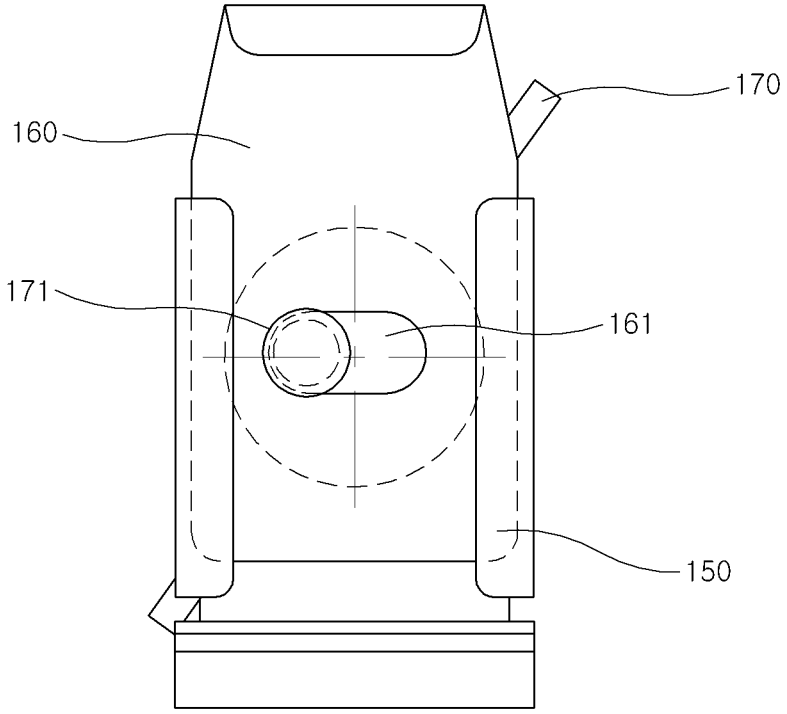

First, as shown in FIG. 3, the rotary hole 152 is formed through the body 151 of the tilting guide 150, and both side ends of the tilting guide 150 are bent to form the movement guide grooves 153. Thereafter, the rear end of the body 151 is bent to be curved, thus defining the coupling hole 154.

After the tilting guide 150 has been formed through the above process, the tilting guide 150 is placed in the housing 140 so that the coupling hole 154 of the tilting guide 150 is aligned with through holes 141 of the housing 140. In this state, the wire spring 160' is inserted into the through holes 141 of the housing 140 and the coupling hole 154 of the tilting guide 150 in such a way as to protrude out from the through holes 141. Ends of the wire spring 160' protruding out from the through holes 141 are bent to be curved, and then are coupled to locking holes 142.

Here, the ends of the wire spring 160' coupled to the locking holes 142 support the movement guide grooves 153 of the tilting guide 150, and the housing 140 and the tilting guide 150 are connected to each other via the restoring part 190. The fixed-side mounting piece 191 of the housing 140 and the operating-side mounting piece 192 of the tilting guide 150 are connected to each other by the restoring member 193 of the restoring part 190. Preferably, the fixed-side/operating-side mounting pieces 191 and 192 and the restoring member 193 are formed in pairs on both sides of the housing 140 and the tilting guide 150 in such a way as to be opposite to each other, thus ensuring a movement without eccentricity.

Further, after the locking hook 160 is coupled to the movement guide grooves 153 of the tilting guide 150, the elongated guide hole 161 of the locking hook 160 and the rotary hole 152 of the tilting guide 150 are located to be aligned with each other. In the state where an end of the handle 170 is coupled to the rotary hole 152, the eccentric pin 171 is coupled to the elongated guide hole 161, so that the locking hook 160 is fastened to the handle 170.

If the tilting guide 150, the locking hook 160 and the handle 170 are mounted to the housing 140 through the above process, the housing 140 is in close contact with the shell 110' having the vertical-movement support block 130 and then is secured thereto by welding or riveting. After the locking housing 120 having the catch hole 121 is secured to the shell 110 by welding or riveting, the flanges 111 of the pair of shells 110 and 110' are in surface contact with the cover and the casing and are fastened thereto through a common method using additional fastening members. In this way, the installation of the present invention has been completed.

The use of the present invention installed by the above process will be described below. As shown in FIGS. 4 to 7, the handle 170 is rotated forwards.

In this case, until the eccentric pin 171 of the handle 170 rotates forwards about the rotary hole 152 of the tilting guide 150, and simultaneously moves from a first side to a second side of the elongated guide hole 161 depending on the rotation radius of the eccentric pin 171, the locking hook 160 to which the eccentric pin 171 is coupled moves rearwards by a predetermined length, and then moves forwards again by a predetermined length to be restored to its original state.

Figure 8:
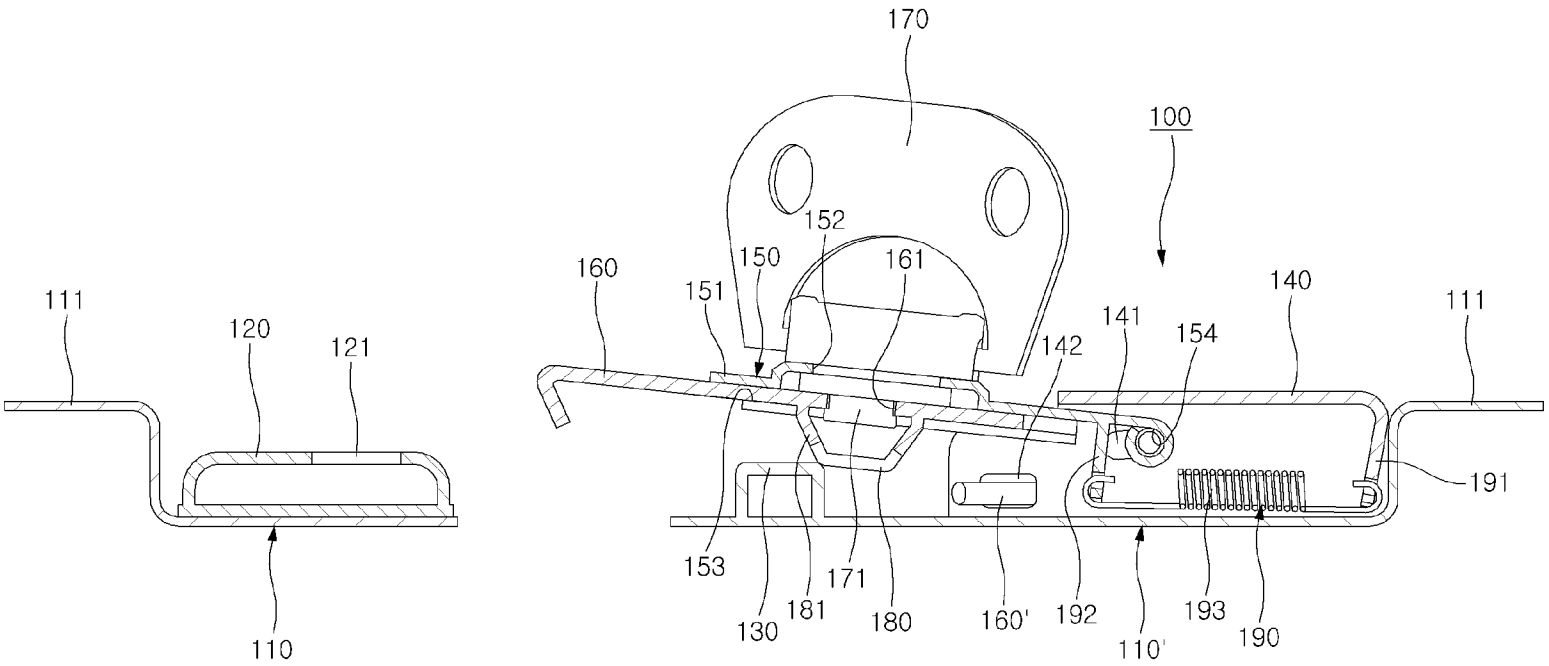
Figure 9:
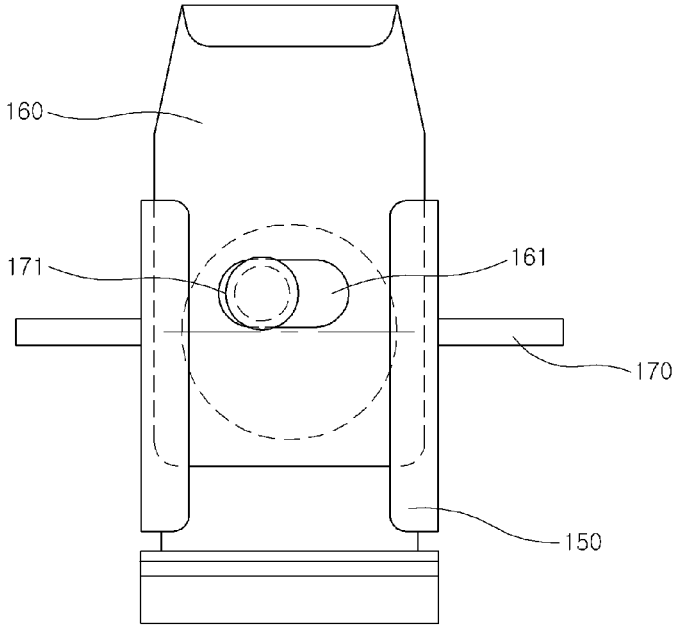
Figure 10:
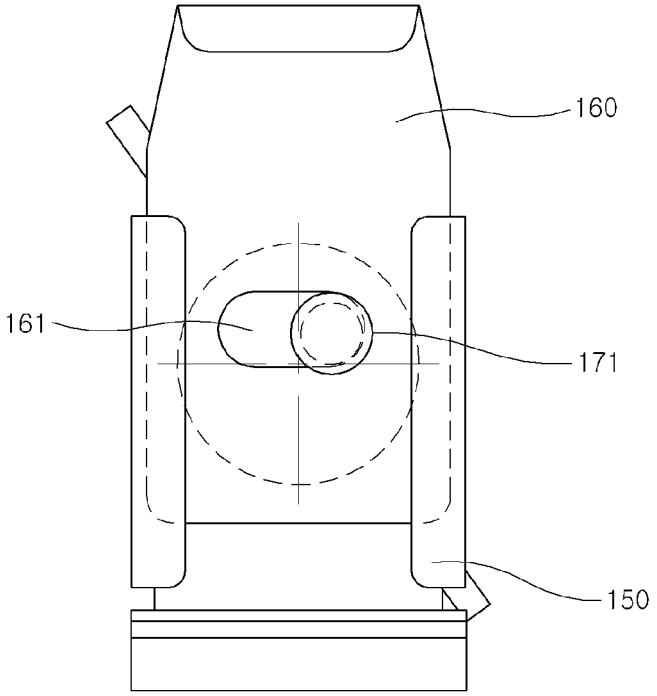

Further, as shown in FIGS. 8 to 10, by the rotation radius of the eccentric pin 171 that rotates forwards, the eccentric pin is moved upwards, i.e. in a direction opposite to the casing to be moved from the second side to the first side of the elongated guide hole 161. Simultaneously, the locking hook 160 through which the elongated guide hole 161 is formed is moved forwards by a length moved in the direction opposite to the casing. While the locking hook 160 is moved, along the movement guide grooves 153 of the tilting guide 150, forwards to a predetermined length by the rotation radius of the eccentric pin 171 that is moved upwards, the vertical moving block 180 protruding from the lower surface of the locking hook 160 is in line contact with the corner of the vertical-movement support block 130 provided on the shell 110', in the longitudinal direction and is moved up along the vertical-movement support block 130.

Here, the frictional surface 181 is preferably inclined or curved such that the vertical moving block 180 is in line contact with the corner of the vertical-movement support block 130. The corner of the vertical-movement support block 130 preferably protrudes at right angles such that the vertical moving block 180 is in line contact therewith in the longitudinal direction to be moved up and down.

In this respect, while the vertical moving block 180 moves up and down along the corner of the vertical-movement support block 130, the locking hook 160 from which the vertical moving block 180 protrudes and the tilting guide 150 to which the locking hook 160 is coupled rotate upwards at predetermined angles about the coupling hole 154 to which the wire spring 160' is coupled, by a height at which the vertical moving block 180 moves up along the vertical-movement support block 130, so that the locking hook 160 and the locking housing 120 are not aligned with each other and simultaneously the restoring part 190 is operated. The restoring part 190 generates a restoring force as the restoring member 193 connected to the operating-side mounting piece 192 of the tilting guide 150 and the fixed-side mounting piece 191 of the housing 140 is extended.

Figure 16:
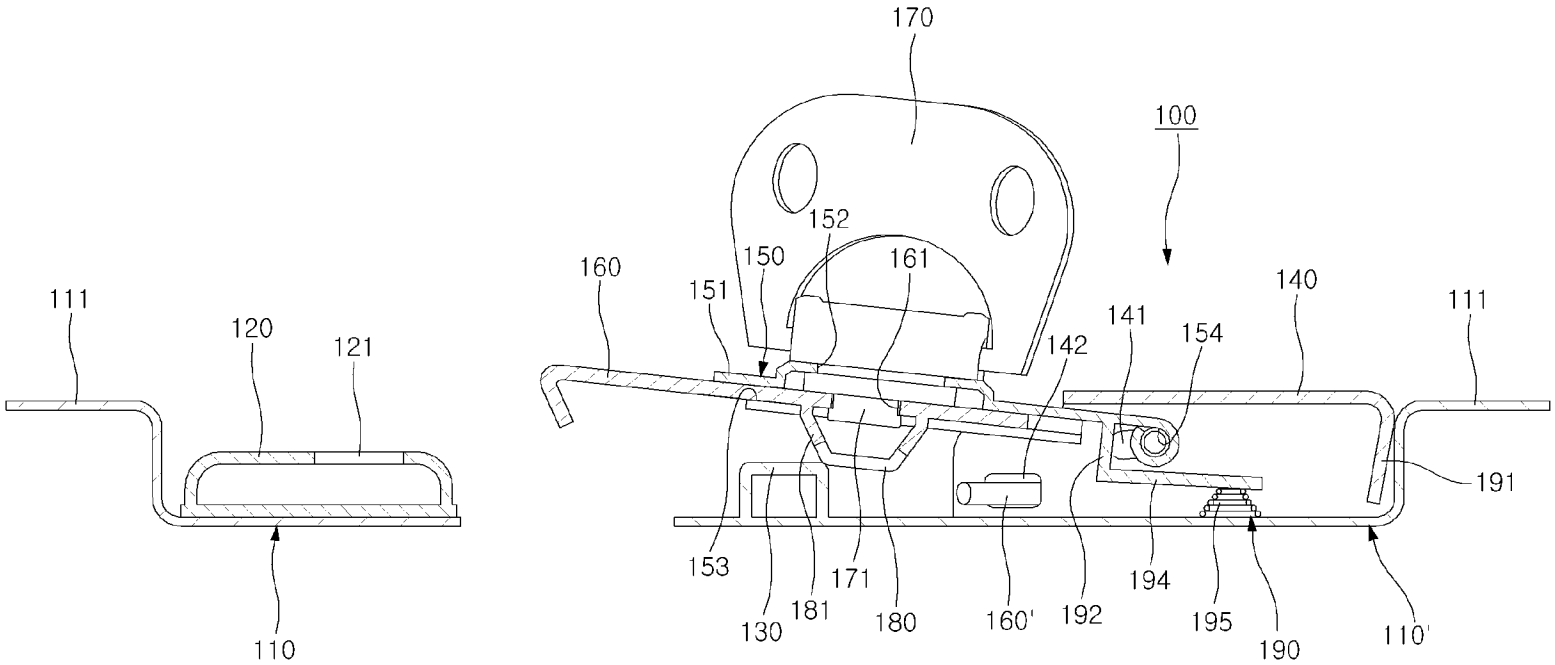
FIGS. 16 and 17 are sectional views showing a restoring part according to another embodiment of the present invention.

As shown in FIG. 16, the restoring part 190 may generate a restoring force as the support member 195 is compressed while the extension piece 194 extending from the tilting guide 150 presses the support member 195 located between the extension piece 194 and the shell 110'.

Figure 17:
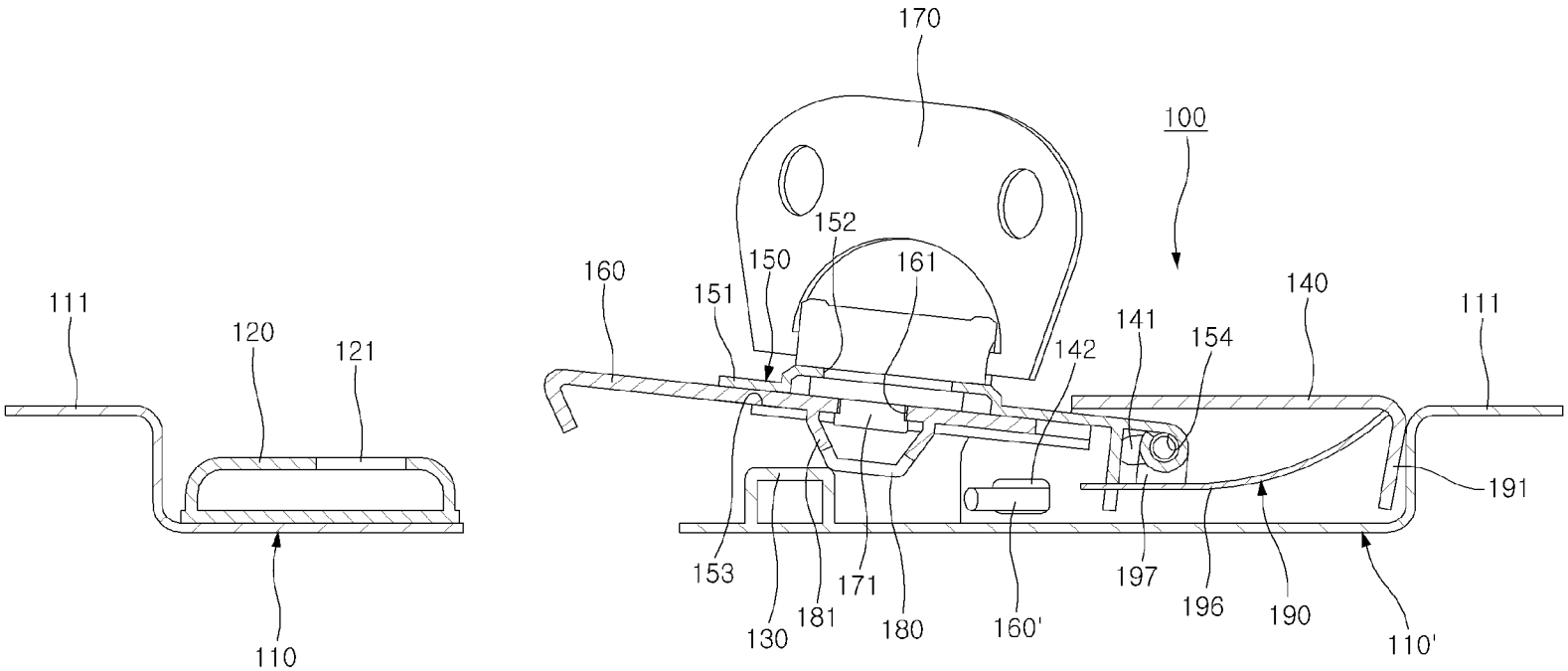

Further, as shown in FIG. 17, the restoring part 190 is configured so that the rib 197 of the plate spring 196 is rotatably coupled to the wire spring 160, the front end of the plate spring 196 is in close contact with the lower surface of the tilting guide 150, and the rear end thereof is in close contact with the inner corner of the housing 140. Thus, as the tilting guide 150 rotates, the plate spring 196 is compressed, so that it is possible to generate a restoring force.

Figure 11:
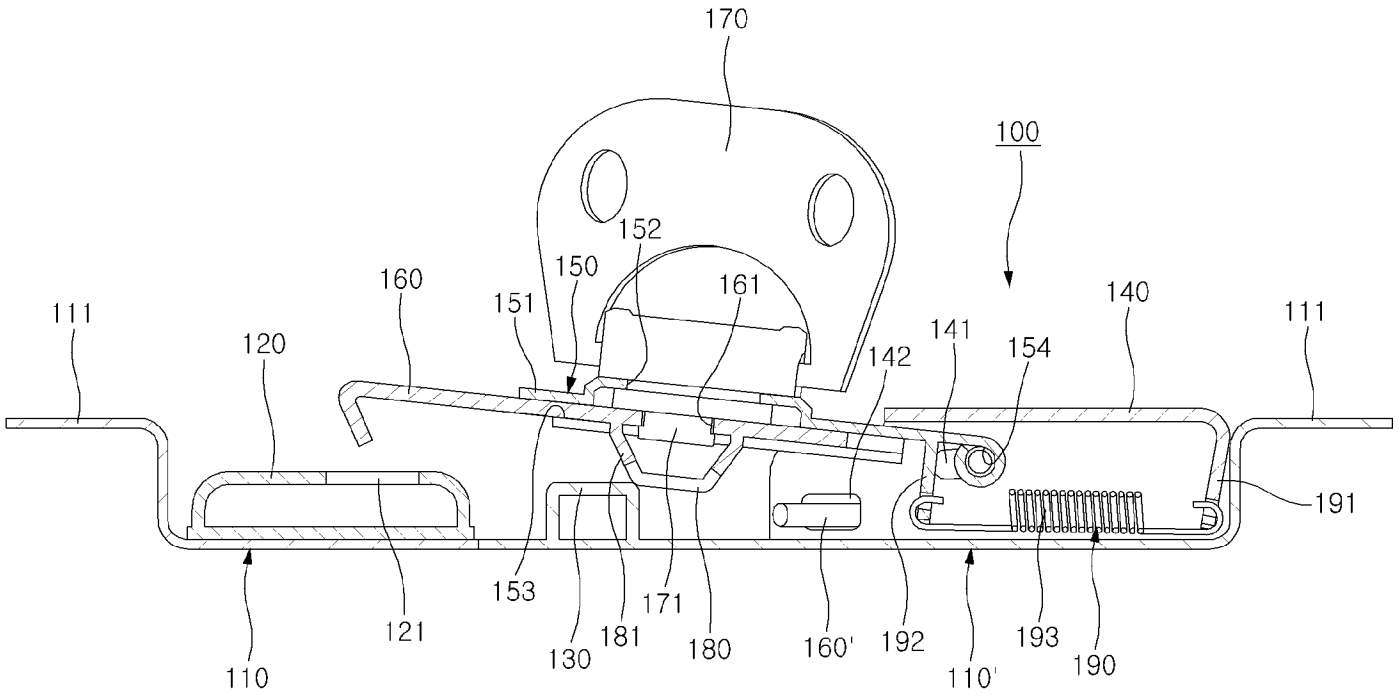

In the state where the locking hook 160 is not aligned with the locking housing 120 through the above-mentioned process, the cover having the shell 110 to which the locking housing 120 is coupled is rotated upwards to open an interior of the casing. Thereafter, expensive goods such as sound equipment are put into the casing, and, as shown in FIG. 11, the cover is rotated downwards, thus closing the interior of the casing.

Figure 12:
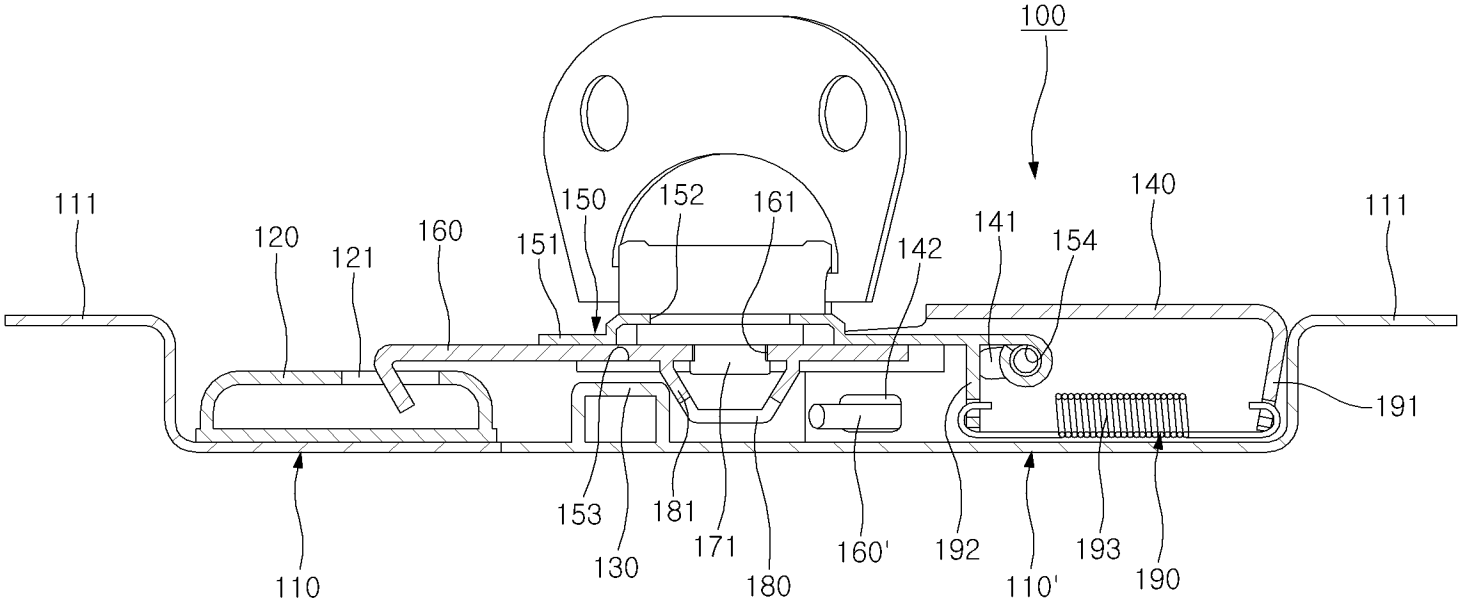
Figure 13:
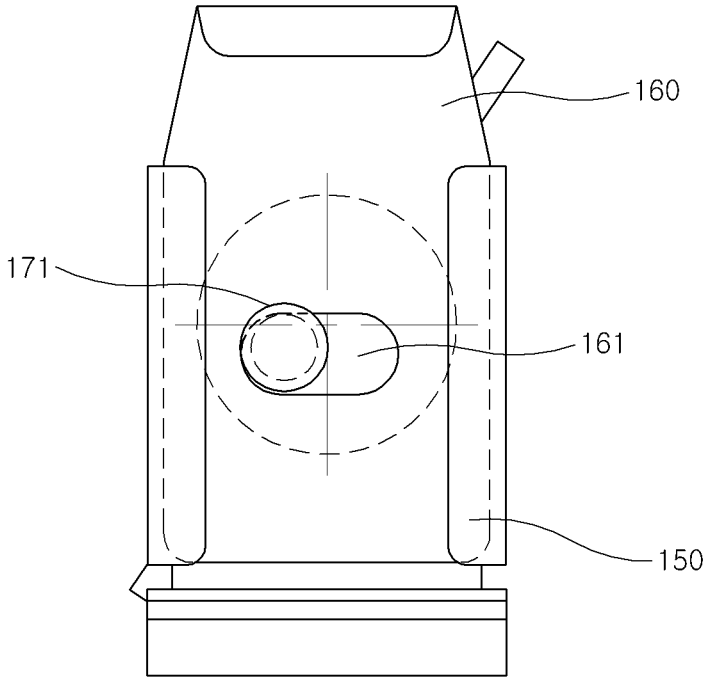

If the interior of the casing is closed by the downward rotation of the cover, as shown in FIGS. 12 and 13, the shell 110 mounted to the cover and the shell 110' mounted to the casing are disposed such that ends thereof are in surface contact with each other, and then the handle 170 is rotated backwards.

In this respect, until the eccentric pin 171 of the handle 170 rotates backwards about the rotary hole 152 of the tilting guide 150, and simultaneously moves from the first side to the second side of the elongated guide hole 161 depending on the rotation radius of the eccentric pin 171, the locking hook 160 to which the eccentric pin 171 is coupled moves forwards to a predetermined length, and then moves rearwards again to be restored to its original state.

Figure 14:
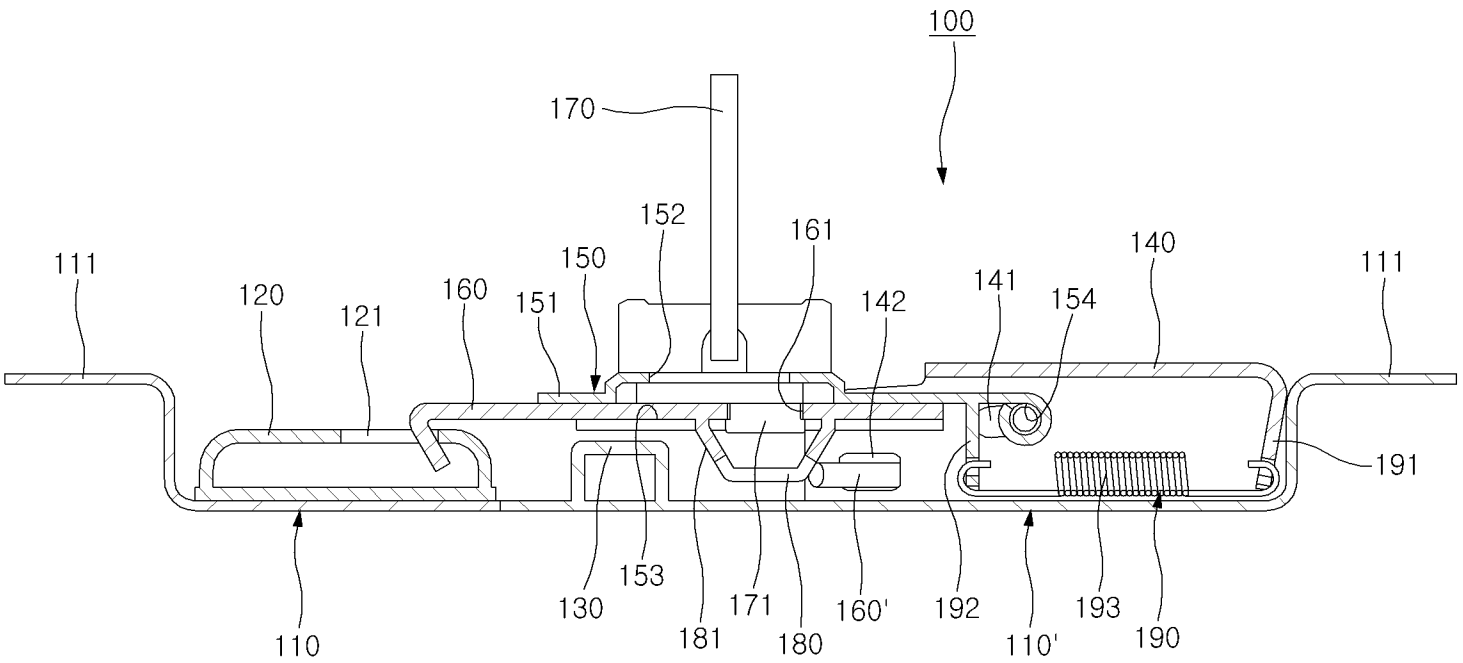
Figure 15:
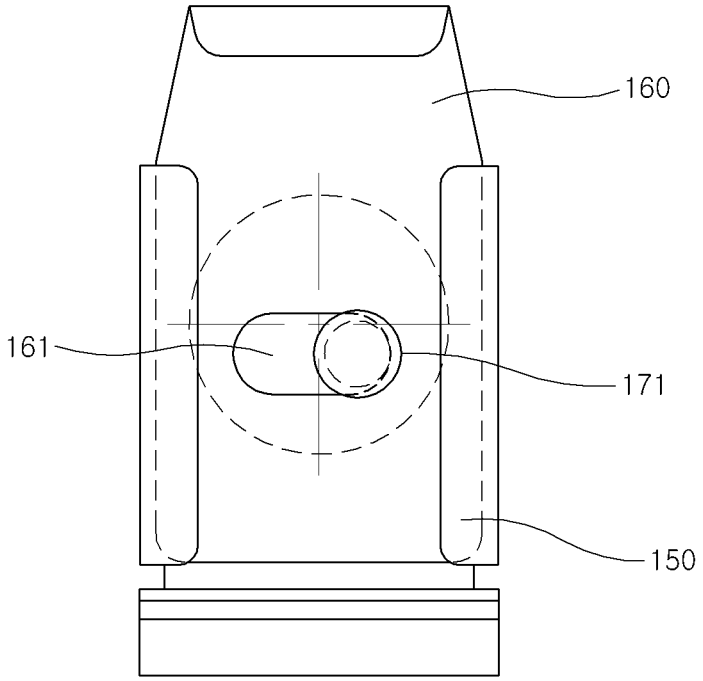

Further, as shown in FIGS. 14 and 15, by the rotation radius of the eccentric pin 171 that rotates backwards, the eccentric pin is moved downwards, i.e. in a direction towards the interior of the casing to be moved from the second side to the first side of the elongated guide hole 161. Simultaneously, the locking hook 160 through which the elongated guide hole 161 is formed is moved rearwards by a length moved in the direction towards the interior of the casing. While the locking hook 160 is moved, along the movement guide grooves 153 of the tilting guide 150, rearwards to a predetermined length by the rotation radius of the eccentric pin 171 that is moved downwards, the vertical moving block 180 protruding from the lower surface of the locking hook 160 is moved down along the corner of the vertical-movement support block 130 provided on the shell 110'.

In this respect, the vertical moving block 180 is moved down along the corner of the vertical-movement support block 130. By the restoring force of the restoring member 193 of the restoring part 190, the fixed-side mounting piece 191 of the housing 140 to which the restoring member 193 is coupled and the operating-side mounting piece 192 of the tilting guide 150 are pulled. Since the fixed-side mounting piece 191 is secured to the housing 140, the locking hook 160 from which the vertical moving block 180 protrudes and the tilting guide 150 to which the locking hook 160 is coupled may perform a downward movement by pulling the operating-side mounting piece 192. When the lower surface of the body 151 of the tilting guide 150 is seated on the wire spring 160', the downward movement is stopped.

In this way, while the locking hook 160 and the tilting guide 150 move down, the bent end of the locking hook 160 is coupled to the catch hole 121 of the locking housing 120. Afterwards, as the handle 170 rotates backwards, the eccentric pin 171 moves from the second side to the first side of the elongated guide hole 161, and simultaneously the locking hook 160 and the tilting guide 170 move rearwards, so that the bent end of the locking hook 160 is caught by the catch hole 121. Therefore, since the cover keeps the casing closed using the locking device 100, expensive goods held in the casing can be safely stored and conveyed.

While the present invention has been described with reference to the embodiments and accompanying drawings, it should be interpreted that terms or words used in the description and claims should not be interpreted as being limited merely to common and dictionary meanings but should be interpreted as having meanings and concepts which are defined within the technical scope of the present invention. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A locking device, comprising:

a first shell having a first flange and a second shell having a second flange, the first flange being adapted to be in surface contact with a casing and the second flange being adapted to be in surface contact with a cover, the first shell being provided with a locking housing in which a catch hole is formed, the second shell being provided with a vertical-movement support block to guide a vertical movement of a locking hook by rotation of a handle;

a housing secured to the second shell to guide an operation of a tilting guide;

the tilting guide resiliently provided inside the housing via a wire spring to guide a movement of the locking hook;

the locking hook configured to be caught by the catch hole to set a locking state or removed from the catch hole to release the set locking state, while the locking hook moves along the tilting guide by a forward or backward rotation of the handle;

the handle rotatably provided on the tilting guide to move the locking hook forwards or rearwards;

a vertical moving block protruding from a lower surface of the locking hook, the vertical moving block being guided along the vertical-movement support block to be in line contact therewith, thus moving up the locking hook that is moved forwards when the handle rotates forwards; and a restoring part connected to the tilting guide and the housing to move down the locking hook and the tilting guide that are moved up while the vertical moving block is in line contact with the vertical-movement support block, thus restoring the locking hook and the tilting guide to original positions thereof.

2. The locking device of claim 1, wherein a corner of the vertical-movement support block is formed to protrude at right angles so that the vertical moving block is in line contact with the vertical-movement support block in a longitudinal direction to be moved up and down.

3. The locking device of claim 1, wherein the tilting guide comprises:

a body through which a rotary hole is formed such that the handle is rotatably mounted thereto;

movement guide grooves formed by bending both sides of the body to guide a movement of the locking hook; and a coupling hole formed by curving a rear end of the body to allow the wire spring to be coupled thereto.

4. The locking device of claim 1, further comprising:

an elongated guide hole formed through the locking hook in a straight line to guide a rotary motion of an eccentric pin for connecting the handle to the locking hook.

5. The locking device of claim 1, wherein a frictional surface of the vertical moving block is curved or inclined to make a side end of the vertical moving block be in line contact with the vertical-movement support block.

6. The locking device of claim 1, wherein the restoring part comprises:

a fixed-side mounting piece formed on a rear end of the housing;

an operating-side mounting piece formed on the tilting guide to correspond to the fixed-side mounting piece; and a restoring member secured to the fixed-side mounting piece and the operating-side mounting piece.

7. The locking device of claim 6, wherein the fixed-side mounting piece or the operating-side mounting piece and the restoring member are formed in pairs on both sides of the housing and the tilting guide in such a way as to be opposite to each other.

8. The locking device of claim 1, wherein the restoring part comprises:

an extension piece extending a rear end of the tilting guide into the housing; and a support member mounted between the extension piece and the second shell to resiliently support the extension piece.

9. The locking device of claim 8, wherein the support member comprises a coil spring.

10. The locking device of claim 1, wherein the restoring part comprises a plate spring, a rib of the plate spring being rotatably coupled to the wire spring, a front end of the plate spring being in close contact with the lower surface of the tilting guide and a rear end of the plate spring being in close contact with an inner corner of the housing.

* * * * *